US005996913A

United States Patent [19]

van der Beek et al.

[11] Patent Number: 5,996,913

[45] Date of Patent: Dec. 7, 1999

[54] METHOD AND DEVICE FOR FEEDING AND OPERATING A FACILITY FOR COMMINUTING RECYCLABLE SCRAP MATERIAL

[75] Inventors: August van der Beek, Grevenbroich; Dieter Karnstädt, Düsseldorf; Erich Köhl, Meerbusch, all of Germany

[73] Assignee: Svedala Lindemann GmbH, Dusseldorf, Germany

[21] Appl. No.: 09/080,805

[22] Filed: May 18, 1998

[51] Int. Cl.[6] ..... B30B 9/32

[52] U.S. Cl. ..... 241/34; 241/186.4; 241/101.4

[58] Field of Search ..... 241/27, 33–35, 241/38, 185.5, 235, 186.4, 30, 101.4, 3

[56] References Cited

U.S. PATENT DOCUMENTS

| | | | |
|---|---|---|---|
| 3,335,967 | 8/1967 | Williams . | |
| 3,426,674 | 2/1969 | Testolin | 241/186.4 X |
| 3,489,078 | 1/1970 | Oberhellmann | 241/186.4 X |
| 3,545,689 | 12/1970 | Luscombe | 241/186.4 |
| 3,545,690 | 12/1970 | Burian et al. . | |
| 3,868,064 | 2/1975 | Coulter et al. | 241/186.4 |

FOREIGN PATENT DOCUMENTS

| | | |
|---|---|---|
| 1006965 | 2/1995 | Belgium . |
| 0 458 059 | 11/1991 | European Pat. Off. . |
| 44 26 505 | 2/1996 | Germany . |

OTHER PUBLICATIONS

Patent Abstracts of Japan, "Waste Crusher with Press Feeder", Shioda Yoshimi.

International Search Report for corresponding application No. PCT/DE98/00568.

International Search Report for corresponding application No. EP 86 63 0085.

*Primary Examiner*—David A. Scherbel
*Assistant Examiner*—Anthony Ojini
*Attorney, Agent, or Firm*—Darby & Darby

[57] ABSTRACT

A method and a device feed and operate a facility, such as a hammer-based crusher, for comminuting recyclable scrap materials, with the scrap material being drawn in with a driven roll and fed to be comminuted as an essentially uniform quantity. Data are collected during the feeding operation and the comminution process for acquiring and controlling operating parameters for feeding the scrap material and for optimizing the operation and the energy efficiency of the comminution process.

14 Claims, 3 Drawing Sheets

METHOD AND DEVICE FOR FEEDING AND OPERATING A FACILITY FOR COMMINUTING RECYCLABLE SCRAP MATERIAL

BACKGROUND OF THE INVENTION

1. Field of the Invention

The present invention relates to a method and an associated device for feeding and operating a facility, such as a hammer-based crusher, for comminuting recyclable scrap material containing metals, e.g. discarded automobiles and/or baled scrap metal, with a feeding device for a continuous feeding operation.

2. Description of the Related Art

Known hammer-based crusher facilities encounter difficulties in maintaining a reliable operation for feeding the scrap material to be comminuted, comminuting the scrap material and finally discharging the comminuted scrap material for further processing. Such difficulties are typically due to problems associated with defining certain values, such as the quantity and dimensions of the scrap material to be fed.

EP 0203026 A2 describes a process flow for a stone crusher, in which data for the crusher are measured and processed between the feeding operation and the comminution process. This process can be employed in this specific situation because the rocks to be comminuted have a relatively homogeneous mineral structure, so that the rock crusher is easier to control. Data in such stone crushers are simply transmitted from a level sensor and a sensor sensing the crusher efficiency, respectively, via respective peripheral interface device (PID) controllers to form control signals for changing the velocity of the drive of the feeding device.

SUMMARY OF THE INVENTION

It is therefore an object of the invention to provide an essentially continuous feed to the comminution process depending on the composition of metal-containing scrap materials to be fed, and to control the operation for highest energy efficiency based on feedback from the comminution process in such a way that the feed velocity of the feeding device is not effected.

The objects of the invention are met by the method of drawing in the scrap material with at least one driven roll; feeding the scrap material in an essentially uniform quantity for comminution; and collecting data during the feeding operation and the comminution process for obtaining and controlling the operating parameters for feeding the scrap material and for an energy-efficient and optimized comminution process.

The objects of the invention are also met by the device employing the disclosed method, with the device having a housing with an integrated sloping plane with lateral borders and forming a loading chute and an upper driven roll; a support for the upper driven roll in a lever system; a pivoted guide mechanism for the upper driven roll disposed in side walls of the housing; a support of the lever system provided by the bearing in the housing as well as against a bias force of at least one element which generates the bias force for adjusting the separation between the upper driven roll and a bottom of the loading chute; a region where the scrap material to be comminuted is transferred from the loading chute, with the region having a boundary defined by the upper driven roll which is adjustable in height relative to the floor and to the side walls of the housing; means for acquiring data during the feeding operation and the comminution process; and means for controlling the required performance data for the feeding operation and the comminution process; with the housing being constructed as a compact physical unit.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

In order to provide a better understanding of the operation of the method, the device will be described first with reference to the following embodiment.

Figure 1:
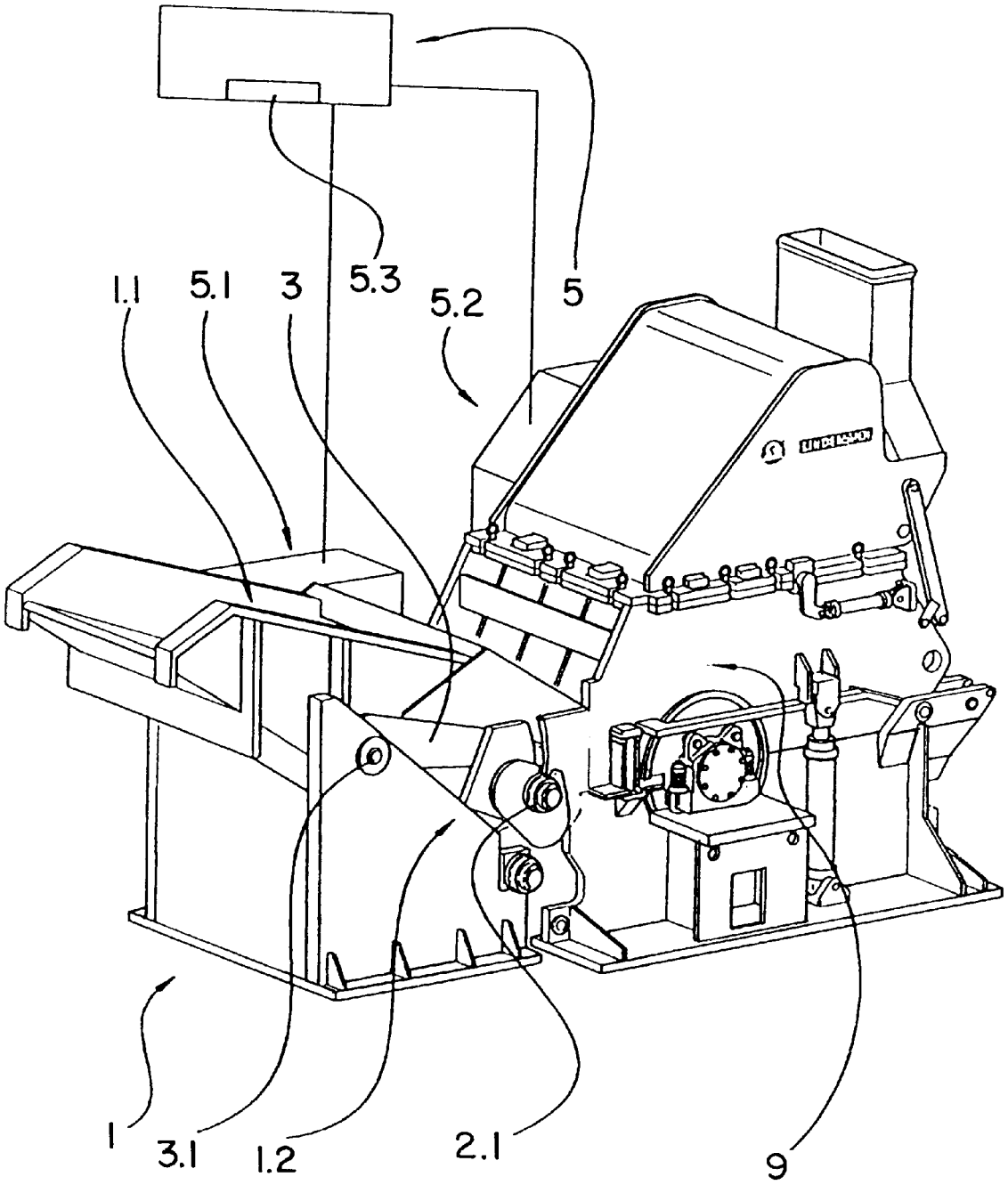
FIG. 1 is a general view of a comminution machine, such as a so-called "ZERDIRATOR", for comminuting scrap materials 4, e.g. discarded automobile bodies, without subsequent dust extraction with the feeding method of the invention.
Figure 3:
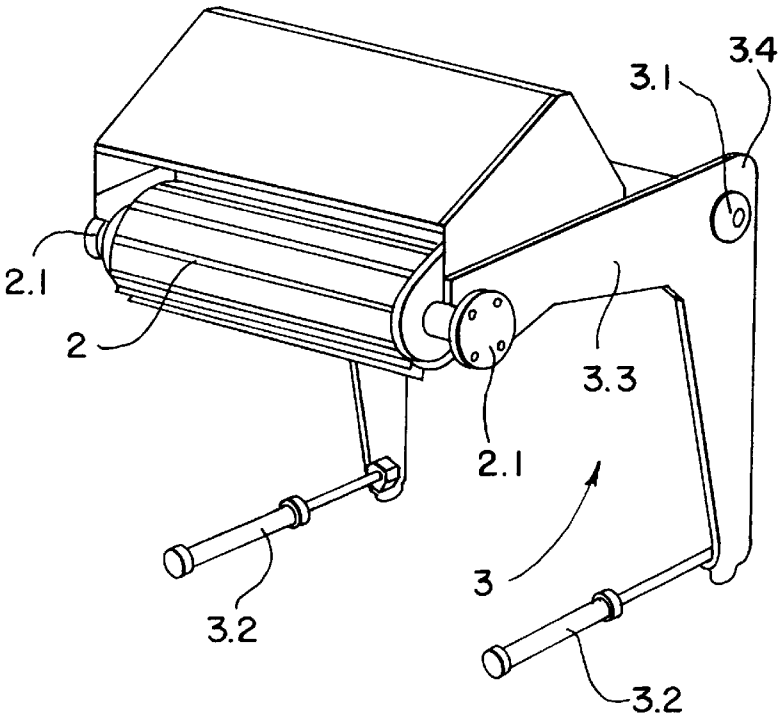
FIG. 3 is a perspective view of an embodiment of a lever system 3 supporting an upper driven roll 2.

Referring first to FIGS. 1 to 4*b*, a feeding device, including a housing 1 with a loading chute 1.1 integrated with the housing 1 and an upper driven roll 2, is located before a comminution machine 9. The comminution machine 9 may be an apparatus known in the art, such as a so-called "ZERDIRATOR", and the comminution machine 9 may have a rotor supported in a housing and driven by a motor; a plurality of pivoted comminution tools; and at least one counter tool disposed in the housing. As illustrated in FIG. 3, the upper driven roll 2 may include an electro-hydrostatic drive, is supported in a lever system 3, and is pivotally guided in the side walls 1.2. The lever system 3 is supported by the bearing 3.1 located in the housing 1 as well as against the bias force of hydraulic cylinders secured on the housing 1 which form elements 3.2 and generate the bias force.

Figure 2:
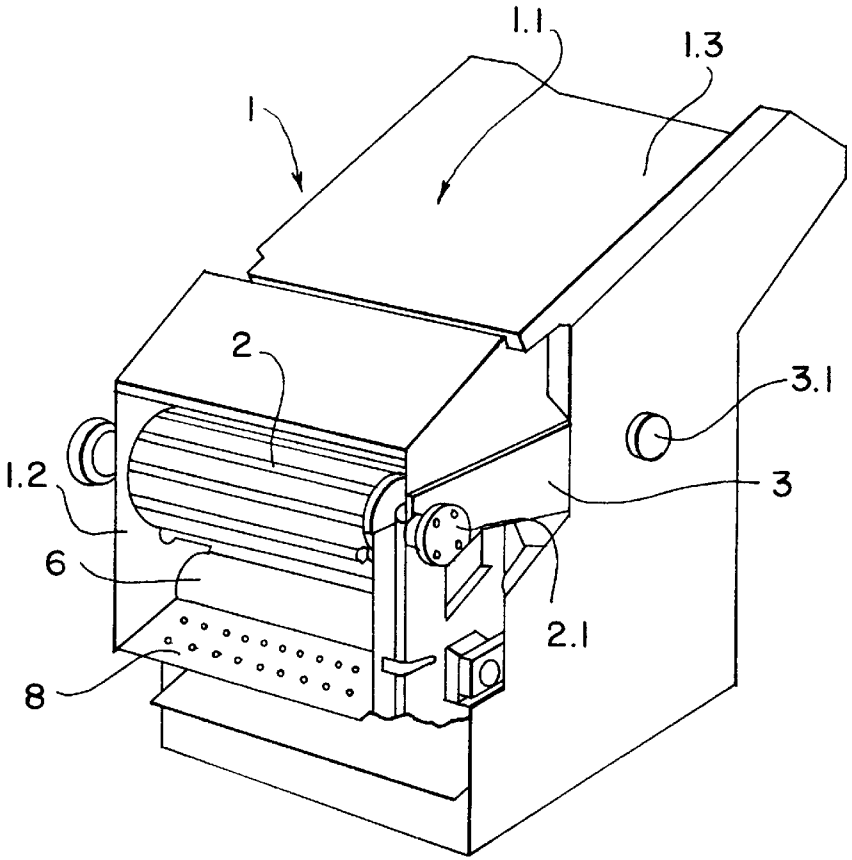
FIG. 2 is a perspective view of an embodiment of a feeding device according to the invention, with particular emphasis on the region where the scrap material 4 is transferred to the comminution machine 9.

The separation between the upper driven roll 2 and a bottom 1.3 can be adjusted for applying pressure to any scrap material to be fed. At the same time, an area shown in FIG. 2 is provided where the scrap material 4 is transferred from the loading chute 1.1 for comminution. The area is restricted by the upper driven roll 2 which can be adjusted in height relative to the floor 1.3, and by the side walls 1.2 in the housing 1. As illustrated schematically in FIG. 1, there are also provided means 5.1, 5.2, 5.3 for acquiring data during the feeding operation and the comminution process and for adjusting the required performance data from a control center 5 of the comminution machine 9.

Such means 5.1, 5.2, 5.3 may be implemented as a computer program and/or software as well as associated hardware known in the art for implementing the functions of the means 5.1, 5.2, 5.3. In addition, sensor and detectors known in the art may be employed as the means 5.1, 5.2, 5.3; for example, the means 5.1 may include a microwave barrier for facilitating detection of the scrap material and data acquisition thereof. Alternatively or in addition, the means 5.1 may measure the fluid pressure of the electro-hydraulic drive of the upper driven roll 2. In addition, the means 5.2 for collecting data and conditions of the comminution process may receive at least one of the values of the current of the drive motor and/or the values of the rotation speed of the comminution machine.

At least one of the current of a drive motor and the rotation speed of a comminution machine may be used to continuously adjust the feed velocity of the scrap material. The step of feeding the scrap material includes automatically feeding the scrap material by recognizing and evaluating at least one of the following states:

a) the presence of scrap material in the loading chute;

b) the presence of scrap material in front of at least one of the rolls;

c) the presence of fed and/or compacted scrap material in the transfer region of the comminution machine;

d) size and load factor of the drive motor of the comminution machine; and e) size and load of at least one of the rolls.

It is a significant feature of the present invention that the housing 1 together with the loading chute 1.1 are constructed as a compact physical unit and include the integrated features described above. To implement this feature, the feeding device is constructed with a significantly reduced number of different components, and a hydraulic drive unit is located in an enclosed space underneath the loading chute 1.1 inside the housing 1. The resulting "shorter transport paths" for the scrap material 4 to be comminuted is beneficial for the entire operation of the facility, which may be a hammer-based crusher.

The design of the lever system 3 advantageously supports the compactness of the device. The lever system 3 includes two mutually parallel knee levers 3.3 in which the ends of the front lever arms have bearings 2.1 for supporting the upper driven roll 2 and in which the ends of the lower lever arms are connected to respective hydraulic cylinders forming elements 3.2 for generating a force. In the region of the knee 3.4, the knee levers 3.3 are connected in order to keep the knee levers 3.3 spaced apart and mutually parallel and to prevent the lever system 3 from twisting.

For feeding the comminution machine 9 according to the method of the invention, the lower driven roll 6 is advantageously disposed at the bottom 1.3 of the loading chute 1.1, so that the loading chute 1.1 does not wear out underneath the upper driven roll 2. Thus, the disadvantageous so-called "banana effect" is eliminated; that is, operation of the comminution machine 9 does not induce a "banana effect" by the one-sided roll pressure which causes the scrap metal to bent upwardly and to miss the entrance opening for comminution. Accordingly, it is unnecessary to provide twin upper pressure rolls which can cause a feeding jam.

Advantageously, the lower driven roll 6 can be lifted out in the upward direction; for example, with the help of a hoist, so that the lower driven roll 6 can be exchanged during a single employee work shift; for example, during maintenance. The region around the lower driven roll 6 is sealed to the bottom and to the side. Dirt and liquids, which penetrate the gap between the lower driven roll 6 and the loading chute 1.1 at this location, are safely collected and transferred to a material discharge channel. Exchangeable wear plates may be disposed at least in the region following the lower driven roll.

The entire feeding device is driven by a closed hydraulic loop, in which the upper driven roll 2 is driven by an electro-hydraulic drive. The hydraulic drive is load-controlled; that is, throughput is high when the scrap metal to be fed is light, whereas the torque is immediately increased for difficult scrap metal. The drive mechanism for the rolls 2 and 6 may be implemented in a manner known in the art.

The feeding device of the invention can deliver a pressure force of, e.g., 500 kN. Normally, the pressure of the upper driven roll 2 on the fed scrap material is generated by gravity. If necessary, an additional hydraulic pressure can be applied for bulky scrap materials. With the present invention, the scrap material is advantageously compressed and fed simultaneously, whereas these two operations were previously carried out separately in the prior art.

As mentioned above, the lever system 3 is reinforced against lateral distortion, preventing twisting when the fed scrap material 4 yields less on one side than on the other side. The installed motor power can thus be used continuously even with difficult scrap materials. More particularly, scrap metal bales can be reliably processed with the method of the invention, since the scrap material to be comminuted can be fed essentially uniformly due to the pressure force applied by the upper driven roll 2.

The lever system 3 is also provided with a lateral shield serving as a splash guard; that is, if the pressure of the driven rolls causes the scrap material to splinter, then the splash guard collects the flying debris. A hydraulically operated pressure cover 7 is provided for particularly bulky scrap material. The pressure cover 7 compresses the fed scrap material which is located before the rolls 2, 6 on the loading chute 1.1, so that the scrap material can be better gripped and pushed into the comminution machine 9.

The aforedescribed feeding device for the comminution machine 9 essentially represents the functional device for carrying out the method of the invention described hereinafter. For feeding and operating a facility for comminuting recyclable scrap materials, e.g. bodies of discarded automobiles and/or scrap metal bales, with the feeding device described above in an essentially continuous feeding operation, the scrap material 4 is drawn in with the driven rolls 2, 6 and is then fed essentially uniformly to be comminuted. Data about the scrap material are collected during the uniform feeding operation via the means 5.1, whereas data of the comminution process are collected via the means 5.2. From these data, control parameters are obtained via the means 5.3 in the control center 5 for operating the facility. The feeding operation for the scrap material 4 to be comminuted can therefore be optimized to operate in the most energy-efficient manner. Such means 5.1, 5.2, 5.3 may be connected to an overload detection device known in the art for detecting an overload of scrap material, and to promptly shut down the facility or portions thereof to prevent overloads or otherwise to protect the facility or portions thereof from damage due to an overload.

The throughput during the feeding operation is controlled based on parameters obtained from data which are fed back by the comminution process, such as data about the size of the objects and/or the machine load factor. The feed velocity and the required feed torque and/or the pressure for at least one of the rolls 2, 6 are then adjusted based on these parameters.

Data representative of the throughput of the scrap material 4 to be comminuted are then acquired and entered as performance data for the comminution process. The rate of utilization of the comminution process is then adjusted for a differentiated feeding operation; and malfunctions, interruptions, effects from errors and/or variations during the operation are analyzed to detect imbalances, oscillations, resonances and/or noises. Thus, signals are generated and provided to operate the plant with the highest possible energy efficiency, to recognize impending severe damages, to prevent breakage of machine elements, and to permit an automatic interruption of the operation of the plant, for example, in conjunction with the overload protection device. Accordingly, such detecting and automatic control is used to generate feedback signals to provide feedback to the steps of the disclosed method to efficiently operate the facility. Moreover, the current operating conditions of the plant can be continuously displayed, monitored and processed in the control center 5 based on the on-line data from the respective event points.

Figure 4A:
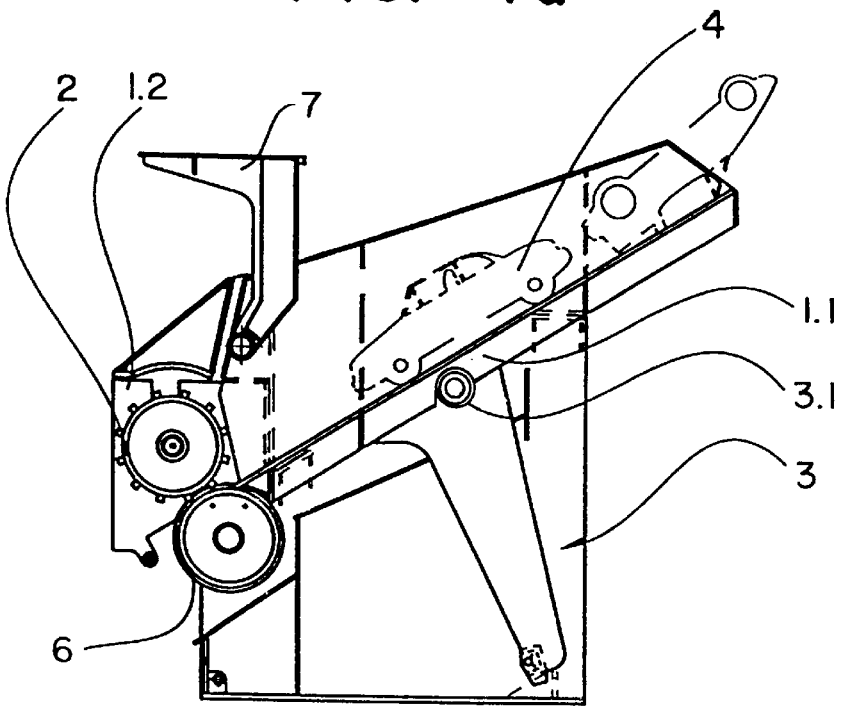
FIG. 4*a* is a side view of an embodiment of the feeding device for particularly in bulky scrap material, with a pressure cover 7 disposed before the upper driven roll 2 with the pressure cover 7 lifted upwards.
Figure 4B:
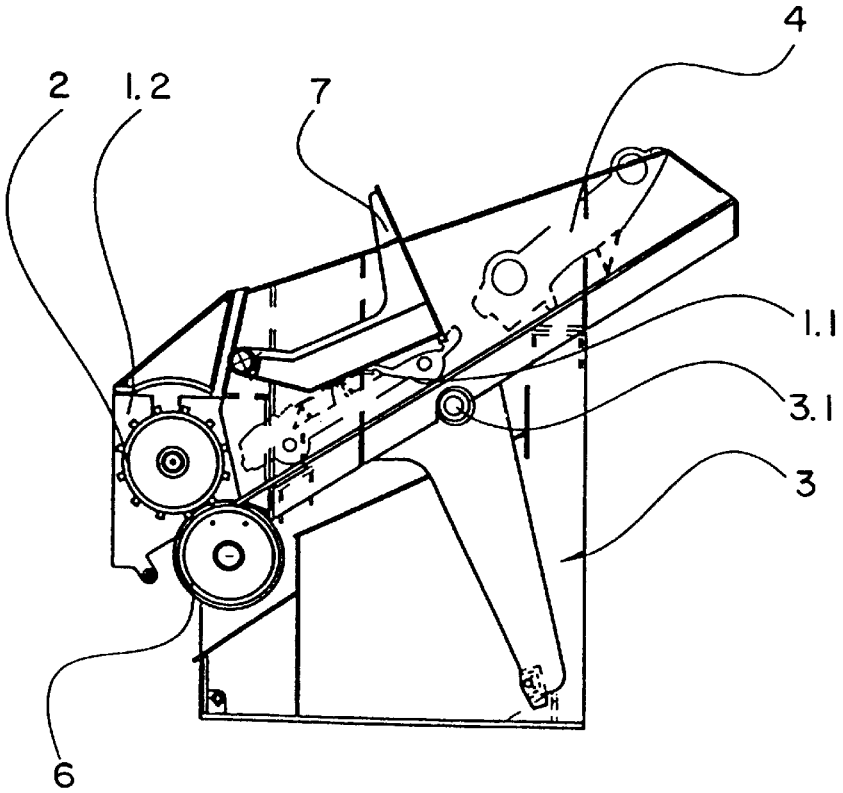
FIG. 4*b* is a side view of the embodiment of FIG. 4*a* with the pressure cover 7 in the position for pre-compression.

FIG. 4*a* is a side view of an embodiment of the feeding device for use with bulky scrap material, with a pressure cover 7 disposed in a path of the scrap material before the upper driven roll 2 and with the pressure cover 7 lifted upwards. FIG. 4*b* is a side view of the embodiment of FIG. 4*a* with the pressure cover 7 in a position for pre-compression.

The disclosed invention thus has industrial applicability to increase the throughput of conventional comminution machines without changing the drive power and the overall dimensions, and also to control the process of feeding an essentially uniformly pre-compressed strand of scrap material to the comminution machine. Such comminution may be implement by having at least one of the driven rolls include flanged wheels providing a stripping function for feeding the scrap material which has been pre-compressed into a strand-like shape, with a defined cross-section.

Thus, while there have been shown, described, and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A hammer-based crusher for comminuting recyclable scrap materials containing metals comprising:

a housing having an upper driven roll and an integrated sloping plane with lateral borders forming a loading chute;

a support for the upper driven roll in a lever system;

a pivoted guide mechanism for the upper driven roll disposed in side walls of the housing;

a support of the lever system by the bearing in the housing as well as against a bias force of hydraulic cylinders which generates the bias force for adjusting the separation between the upper driven roll and a bottom of the loading chute;

a region where the scrap material to be comminuted is transferred from the loading chute, the region having a boundary defined by the upper driven roll which is adjustable in height relative to the floor and to the side walls of the housing;

means for acquiring data during the feeding operation and the comminution process;

means for controlling the required performance data for the feeding operation and the comminution process; and wherein the housing is constructed as a compact physical unit.

2. The device according to claim 1, wherein the lever system includes two mutually parallel knee levers;

wherein the ends of the front lever arms support the upper driven roll in bearings;

wherein the knees of the knee levers are supported in the housing by bearings;

wherein the end of each of the lower knee lever arms is connected to a respective biasing element supported on the housing; and wherein the knee levers disposed at least in the region of the knee are connected so as to ensure a mutual parallel separation and essentially distortion-free operation of the lever system.

3. The device according to claim 1, wherein the housing includes at least one force-generating element and at least one drive unit.

4. The device according to claim 1, wherein the bottom of the loading chute having at least one lower driven roll which is supported in the housing.

5. The device according to claim 1, wherein a pressure cover is disposed in a path of the scrap material before the upper driven roll.

6. The device according to claim 1, wherein the force generating element is a hydraulic cylinder with a piston for applying a force to the upper driven roll via the knee lever.

7. The device according to claim 1, wherein a drive unit is provided for driving at least one of the driven rolls.

8. The device according to claim 1, wherein at least one of the driven rolls includes flanged wheels providing a stripping function for feeding the scrap material which has been pre-compressed into a strand-like shape, with a defined cross-section.

9. The device according to claim 1, wherein at least one the driven rolls is connected to a hydraulic drive.

10. The device according to claim 1, wherein exchangeable wear plates are disposed at least in the region following the lower driven roll.

11. The device according to claim 1, wherein the means for acquiring data and conditions during the feeding operation include at least one microwave barrier.

12. The device according to claim 1, wherein the means for collecting data and conditions of the comminution process receives at least one of the values of the current of the drive motor and the values of the rotation speed of the comminution machine.

13. The device according to claim 1, wherein the upper driven roll includes a hydrostatic drive.

14. The device according to claim 1, wherein the means for collecting data and conditions during the feeding operation measures the fluid pressure of the electro-hydraulic drive of the upper driven roll.

* * * * *

UNITED STATES PATENT AND TRADEMARK OFFICE

CERTIFICATE OF CORRECTION

PATENT NO. : 5,996,913

DATED : Dec 7, 1999

INVENTOR(S) : August Van Der BEEK et al.

It is certified that errors appear in the above-identified patent and that said Letters Patent is hereby corrected as shown below:

Title page, [75] Inventors, please add the fourth inventor --THOMAS SPIESSHOFER, DORMAGEN, FED REP GERMANY-- .

Signed and Sealed this

Twelfth Day of September, 2000

*Attest:*

Q. TODD DICKINSON

*Attesting Officer*

*Director of Patents and Trademarks*